United States Patent [19]

Kessler

[11] 4,401,172

[45] Aug. 30, 1983

[54] DRILLING TOOL

[75] Inventor: Jürgen Kessler, Stuttgart, Fed. Rep. of Germany

[73] Assignee: Hilti Aktiengesellschaft, Schaan, Liechtenstein

[21] Appl. No.: 266,094

[22] Filed: May 21, 1981

[30] Foreign Application Priority Data

May 27, 1980 [DE] Fed. Rep. of Germany ..... 3020143

[51] Int. Cl.[3] ..... E21B 10/32

[52] U.S. Cl. ..... 175/283

[58] Field of Search ..... 166/258, 279, 281, 284, 166/285, 286, 289, 291, 288

[56] References Cited

U.S. PATENT DOCUMENTS

| | | | |
|---|---|---|---|
| 399,156 | 3/1889 | Plom et al. | 175/288 X |
| 1,259,319 | 3/1918 | Toth | 175/288 |
| 1,451,794 | 4/1923 | Stokes | 175/288 X |
| 1,833,134 | 11/1931 | Stokes | 175/288 X |
| 1,836,703 | 12/1931 | Christensen | 175/288 X |
| 3,406,769 | 10/1968 | Kammerer, Jr. | 175/286 X |

FOREIGN PATENT DOCUMENTS 810924 3/1981 U.S.S.R. .

*Primary Examiner*—Stephen J. Novosad
*Assistant Examiner*—Joseph Falk
*Attorney, Agent, or Firm*—Toren, McGeady and Stanger

[57] ABSTRACT

A tool which makes an undercut in the surface surrounding a drill hole in a layer of coal has a head plate which abuts against the surface at the inner end of the hole when the tool is inserted and which is installed at the front end of a rotary tubular guide for two bit holders constituting one-armed levers and having front portions provided with bits and being movable radially outwardly through windows in the guide. The rear portions of the holders are coupled to the front part of a reciprocable rotary shank which can be moved forwardly to expel the bits from the guide while moving the holders forwardly. When the shank is retracted, the bits are withdrawn into the guide. Such movements of the bits are caused by a transverse pin mounted in the guide and extending through elongated cam grooves in the median portions of the holders. The configuration of surfaces flanking the cam grooves is such that the bits move outwardly during a first stage of forward movement of the shank relative to the guide and the bits thereupon remain in extended positions and make a cylindrical portion of the undercut in the surface surrounding the hole during the last stage of axial movement of the shank into the guide. The tool is thereupon withdrawn and replaced with an anchor bolt which can be expanded against the surface portion surrounding the undercut and serves as a supporting or holding device.

19 Claims, 4 Drawing Figures

DRILLING TOOL

CROSS-REFERENCE TO RELATED APPLICATIONS

The tool of the present invention constitutes an improvement over and a further development of the tool which is disclosed in the commonly owned copending application Ser. No. 242,916, filed Mar. 12, 1981 for "Drilling Tool". Anchor bolts which can be inserted into holes after treatment with the tool of the present invention are disclosed in commonly owned copending application Ser. No. 242,915, filed Mar. 12, 1981 for "Anchor Bolt".

BACKGROUND OF THE INVENTION

The present invention relates to drilling tools in general, and more particularly to improvements in drilling tools which can be utilized for enlargement of selected portions of predrilled or basic drill holes in layers of coal or the like.

German Pat. No. 23 31 467 and German Offenlegungsschrift No. 28 56 855 disclose tools which can be used to make conical enlargements or undercuts in the surfaces surrounding relatively short or shallow holes or bores in concrete or a like hard material. The tool has a shaft which carries two bit holders at its forward end which is flattened, and each bit holder constitutes a two-armed lever the front arm of which carries the bit and the rear arm of which has a slot for a guide adapted to pivot the lever whereby the bit moves radially of and away from the axis of the shaft. The guide is held by a stop while the bit holders are caused to move forwardly, i.e., into the hole. The stop which holds the guide is subjected to tensional stresses while the holders move forwardly and thereby pivot so as to move the bits outwardly. During such pivoting of the holders, the bits move away from the pivot axes of the respective holders.

A drawback of the just described conventional tool is that it cannot be used for the making of conical or otherwise configurated enlargements or undercuts in surfaces surrounding relatively deep holes, e.g., holes which are formed in relatively soft material and whose depth is in excess of 1 meter, e.g., between 1.2 and 1.8 m. This is due to the fact that the aforementioned stop is located externally of the hole. Moreover, the material which is removed by the bits of a conventional tool is highly likely to interfere with pivotal movements of the bit holders so that the bits cannot be retracted prior to withdrawal of the tool from the hole upon completion of the enlargement. When the material around the hole is relatively soft, the bits are likely to remove minute particles in the form of powder or dust as well as relatively large fragments which interfere with movements of the bit holders. When in neutral or innermost positions, the bit holders must lie against the flattened front end portion of the shaft in order to allow for extraction of the tool from the hole. The spring which is used in this conventional tool to retract the bits is often too weak to perform its function when the tool is to be withdrawn from the hole, especially after removal of relatively large fragments of material around the hole. Finally, the configuration of surfaces bounding the cam grooves in the rear arms of the bit holders is such that the holders must pivot through relatively large angles which further reduces the likelihood that even a reasonably strong spring could retract the holders preparatory to extraction of the tool from the hole in the event that the hole contains relatively large fragments of removed material.

OBJECTS AND SUMMARY OF THE INVENTION

An object of the invention is to provide a novel and improved drilling tool which can be used for the making of conical and/or otherwise configurated enlargements in the surfaces surrounding predrilled holes in layers of coal or the like and which is constructed and assembled in such a way that the removed material is not likely to interfere with movements of its parts preparatory to as well as during extraction from the hole.

Another object of the invention is to provide a drilling tool of the above outlined character, particularly for use in the coal mining industry, which is constructed and assembled in such a way that it can be withdrawn from the hole with a minimum of effort and which offers relatively small resistance to rotation and/or other movements in a predrilled hole.

A further object of the invention is to provide a tool which can be used for the making of composite enlargements in predrilled holes, for example, for the making of enlargements which are bounded by cylindrical as well as by conical surfaces.

An additional object of the invention is to provide novel and improved means for moving the bits of the tool relative to their guide so as to allow for penetration of bits into or for retraction of bits from the material around the hole.

Still another object of the invention is to provide a tool which can be used with advantage for the making of conical or other enlargements in surfaces close to the inner ends or bottoms of relatively deep blind holes or bores in layers of coal or other relatively soft material.

An additional object of the invention is to provide novel and improved means for imparting reciprocatory movements as well as rotary movements to the guide for the bit holders.

Another object of the invention is to provide novel and improved means for reducing the resistance which the guide for the bit holders encounters to rotation during movement with reference to the surface surrounding the hole.

The invention resides in the provision of a drilling tool which is capable of making a conical enlargement or undercut in the surface surrounding a blind hole having a bottom, particularly in that portion of such surface which is close or rather close to the bottom of a relatively deep hole. The tool comprises an elongated rotary tubular guide which is insertable into the hole and has a plurality of openings or windows, and a plurality of elongated bit holders in the guide, one for each window and each having a front portion provided with a bit and being movable radially of the guide so that the bits can extend outwardly through the respective windows to remove material from the surface around the hole while the guide rotates or that the bits can be retracted into the guide. The holders are further formed with elongated cam grooves between their front and rear portions, and the tool has cam means installed in the guide and extending transversely of and through the grooves. The surfaces flanking the grooves are designed to ensure that the bits are moved substantially radially outwardly to extended positions in response to movement of the holders lengthwise of the guide and in a first direction (toward the bottom of the hole) and back into the guide in response to movement of the holders in a second direction counter to the first direction. Still further, the tool comprises means for reciprocating the holders with reference to and axially of the guide, and such reciprocating means comprises a shank, means for pivotally connecting the shank to the rear portions of the holders, and means for moving the shank axially of the guide.

The guide is preferably formed with limiting surfaces bounding the windows and serving as abutments for the bit holders, at least while the respective bits remove material from the surface around the hole. The limiting surfaces are contacted by the rear portions of the holders in the extended positions of the bits. The width of the windows, as considered in the circumferential direction of the guide, preferably exceeds the corresponding dimensions of the holders to allow the removed material to find its way away from the path of movement of the holders during retraction of the bits, i.e., preparatory to removal of the tool from the hole.

A head is preferably interposed between the guide and the bottom of the hole, and the guide is rotatable relative to the head. The latter may resemble a plate, and an antifriction bearing (e.g., a spherical element) can be interposed between the head and the guide so that the guide can rotate with a minimum of friction while the bits remove material from the surface around the hole.

The novel features which are considered as characteristic of the invention are set forth in particular in the appended claims. The improved drilling tool itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

The improved drilling tool 11 serves to make a conical enlargement 12 at the inner end or bottom 14 of a cylindrical basic drill hole 13 in a relatively soft material, e.g., in the coal bed of a coal seam. For example, the depth of the basic drill hole 13 may be in the range of 1.20 to 1.80 m or even greater. The conical enlargement is provided near the bottom 14 of the drill hole 13 and serves to accommodate a complementary internally threaded fixing peg or anchor bolt which is inserted in the non-expanded state by a threaded tie rod or the like (not shown). The peg can then expand in the conical enlargement 12 and is fastened with the aid of the tie rod so that supporting and/or holding elements or the like can be connected to the tie rod externally of the coal bed.

Figure 1:
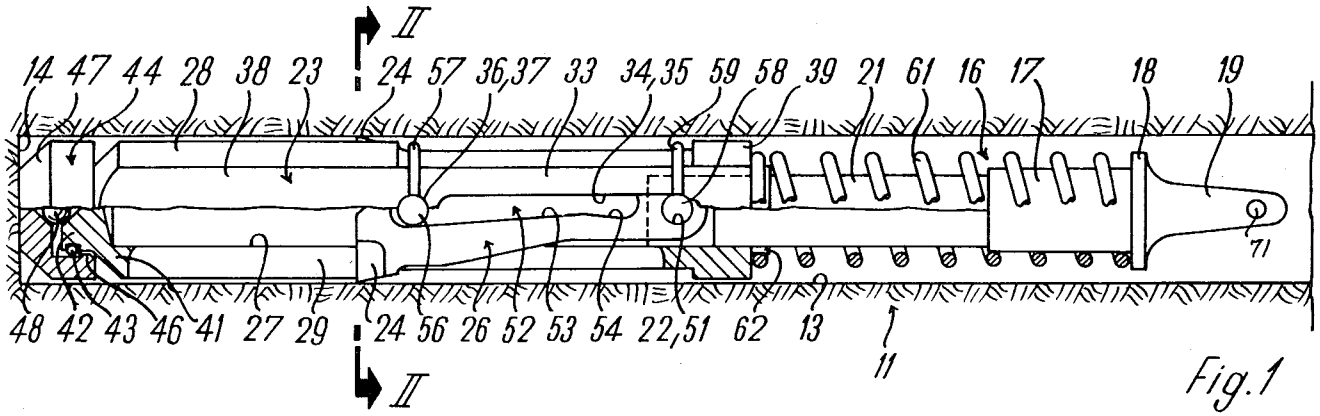
FIG. 1 is a side elevational view of a drilling tool which embodies one form of the invention and is inserted into a basic drill hole, parts of the tool being shown in section and the bits of the tool being shown in retracted positions.
Figure 3:
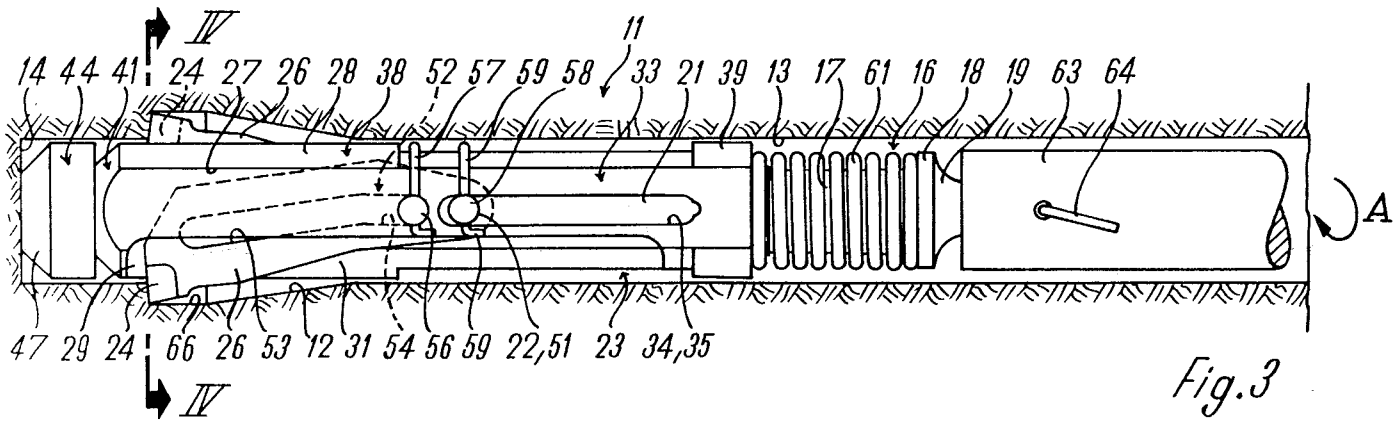
FIG. 3 is a side elevational view similar to that of FIG. 1 but showing the parts in the positions they assume after the making of a conical enlargement in the basic drill hole and with the bits extending from their guide means.

As shown in FIGS. 1 and 3, the drilling tool 11 has a one-piece tool shank 16 which includes a cylindrical central portion 17 followed by a collar 18 and a plate-like fixing tenon 19 which tapers rearwardly, i.e., toward the open end of the drill hole 13. The portion 17 is located behind a front fastening plate 21 with a rectangular cross-section. The width of the broad side of the plate 21 corresponds to the diameter of the cylindrical portion 17.

Figure 2:
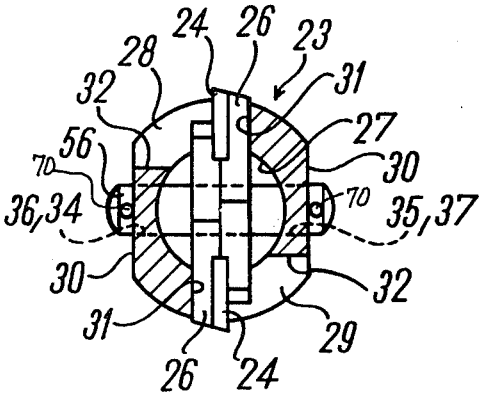
FIG. 2 is a sectional view as seen in the direction of arrows from the line II—II of FIG. 1.
Figure 4:
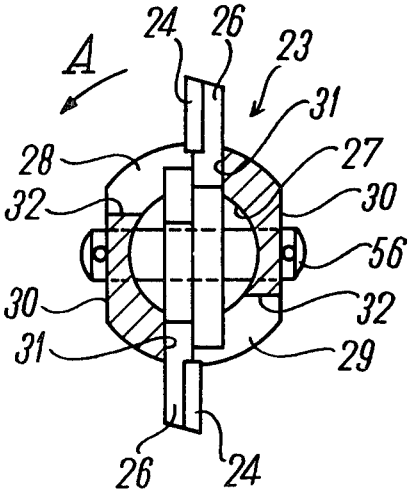
FIG. 4 is a sectional view as seen in the direction of arrows from the line IV—IV of FIG. 3.

In addition, the drilling tool 11 has an at least partially hollow cylindrical guide element or guide 23 wherein two bit holders 26, each provided with a removable bit 24, can be moved axially and deflected outwardly in the radial direction of the cylindrical portion 17. The bit holders 26 are articulately connected to the fastening plate 21 of the tool shank 16 which, during axial movement with reference to the guide 23, penetrates into the latter. The guide 23 has a blind bore or passage 27 which is open at the rear end and extends practically over its entire length. As shown in FIGS. 2 and 4, the guide 23 is provided with flat parallel lateral surfaces 30 and its cylindrical wall has two windows or openings 28 and 29 located diametrically opposite each other and extending from the inner end of the blind bore 27 into close proximity of the rear end of the guide 23. The windows 28 and 29 are closed at their axial ends and define paths for movement of bits 24 from the exterior of the guide 23 into the blind bore 27. The windows 28 and 29 extend along angles of 90 degrees, as considered in the circumferential direction of the guide 23, and each thereof is bounded by two limiting surfaces 31 and 32. These limiting surfaces are normal to each other and each thereof is parallel to a plane including the axis of the guide 23 (see FIGS. 2 and 4). In other words, and referring to FIG. 2, the limiting surfaces 32 are parallel to a first symmetry plane which is horizontal and includes the axis of the guide 23, and the limiting surfaces 31 are parallel to a second (vertical) symmetry plane which also includes the axis of the guide 23. The distance between the limiting surfaces 31 and the vertical symmetry plane equals the thickness of a bit holder 26, and the distance between the surfaces 32 and the horizontal symmetry plane slightly exceeds such thickness. FIGS. 2 and 4 further show that the bit holders 26 have side faces which abut against the respective limiting surfaces 31. The bit holders 26 are parallel to the limiting surfaces 31 which extend lengthwise of the tool shank 16. In FIG. 2, the bits 24 are practically fully retracted into the respective windows 28, 29. On the other hand, FIG. 4 shows the two bits in fully or nearly fully extended positions in which they extend outwardly beyond the peripheral surface of the guide 23.

The flat surfaces 30 of the guide 23 are formed with elongated parallel guide slots 34 and 35 which are disposed diametrically opposite each other and in a horizontal plane, as viewed in FIG. 2 or 4, i.e., the plane of the slots 34, 35 is normal to the limiting surfaces 31 for the bit holders 26. The slots 34 and 35 are machined into or otherwise formed in an intermediate portion or zone 33 of the guide 23. The front end portions of the slots 34 and 35 are respectively adjacent to radial bores 36, 37 (see FIGS. 2 and 3) which are coaxial with one another and are also machined into the flat surfaces 30 of the guide 23. The intermediate portion 33 of the guide 23 extends essentially from the foremost portions of the bores 36, 37 to the rear ends of the slots 34, 35 and its outer diameter is smaller than the outer diameter of the front portion 38 of the guide 23. The reference character 39 denotes a collar at the rear end of the intermediate portion 33; the outer diameter of this collar matches or approximates that of the front portion 38.

The foremost portion or part 41 of the guide 23 is closely adjacent to the inner end of the blind bore 27 and includes a forwardly tapering conical zone merging into a substantially cylindrical stub or trunnion 42 having an external circumferential groove for a split ring 43 which is located in front of an internal annular shoulder provided in the cylindrical portion of a head plate 44. The head plate 44 has a forwardly tapering end portion or tip 47 which is a conical frustum and abuts against the bottom 14 of the drill hole 13. The aforementioned internal shoulder is located at the front side of an inwardly extending annular flange 46 of the head plate 44; the flange 46 ensures that the plate 44 cannot be accidentally separated from the foremost part 41 of the guide 23. The front end face of the trunnion 42 has a relatively small conical or frustoconical recess or socket which is adjacent to a complementary mirror symmetrical socket in the head plate 44. The two sockets receive a spherical element 48 which constitutes a bearing and allows the guide 23 to rotate relative to the head plate 44 with a minimum of friction.

The bit holders 26 are mirror images of one another and are confined in the guide 23 during introduction of the tool 11 into the bore 13. The bits 24 face in the opposite directions; the manner in which the bits 24 are separably or permanently secured to the respective holders 46 forms no part of the present invention.

The rear end portions of the substantially plate-like bit holders 26 have transverse holes 51 for a pivot member 58 which enables the bit holders to pivot with reference to each other abot an axis which is normal to the axis of the guide 23. As shown in FIGS. 2 and 4, each of the bit holders 26 has a substantially rectangular cross-sectional outline. The bit holders 26 are further formed with composite cam grooves 52 each of which includes a relatively long front portion 53 and a shorter rear portion 54. The cam grooves 52 resemble dogs legs and are disposed between the transverse holes 51 and the respective bits 24. The front ends of the rear portions 54 merge into the rear ends of the respective front portions 53. When the bits 24 are retracted into the guide 23, the longitudinal direction of the longer portion 53 of each cam groove 52 makes with the axis of the guide 23 an angle of approximately 3.5 degrees, i.e., a relatively small acute angle. At such time, the longitudinal directions of the shorter portions 54 and the axis of the guide 23 make slightly larger angles of approximately 5 degrees. The portions 53 and 54 of both cam grooves 52 slope outwardly and forwardly, i.e., toward the respective bits 24. More particularly, the portions 53 and 54 slope outwardly toward the outer edge faces of the respective bit holders 26.

To assemble the bit holders 26 with the guide 23 and the shank 16, the bit holders are inserted into the guide in a manner as shown in FIG. 2. A coupling pin 56 is thereupon inserted into bores 36, 37 of the guide 23 so that it extends through the cam grooves 52 of both bit holders. The coupling pin 56 then constitutes a cam which causes the bits 24 to move radially outwardly of the guide 23 in response to forward movement of the holders 26 because the pin 56 then contacts the surfaces bounding the portions 53, 54 of the cam grooves and compels the front parts of the holders to move outwardly and beyond the respective windows 28, 29. As shown in FIGS. 2 and 4, the end portions of the coupling pin 56 extend beyond the flat surfaces 30 and are provided with diametrically extending holes 70 for the end portions of an arcuate wire 57 serving to hold the pin 56 against axial movement transversely of the guide 23.

The rear portions of the bit holders 26 are of reduced thickness so that they can flank the front fastening plate 21 of the shank 16. This can be achieved by machining shoulders into the inner sides of the bit holders 26, i.e., into those sides which face one another. If desired, the front portion of the fastening plate 21, too, can be of reduced thickness to readily fit between the rear portions of the bit holders 26. The front portion of the plate 21 has a transverse hole 22 for pivot pin 58 which extends through the aligned slots 34, 35 of the intermediate portion 33 and the transverse holes 51 of the bit holders 26. The end portions of the pin 58 extend beyond the intermediate portion 33 and have diametrically extending holes for the end portions of an arcuate wire 59 shown in FIGS. 1 and 3 and serving to hold the pin 58 against axial movement transversely of the intermediate portion 33.

A compression spring 61 or another suitable biasing device is slid onto the cylindrical portion 17 and front fastening plate 21 of the shank 16 before the latter is coupled to the bit holders 26, i.e., before the front end portion of the plate 21 is inserted into the rear end portion of the guide 23. The rearmost convolution of the spring 61 reacts against the collar 18 of the shank 16 and the foremost convolution of this spring bears against the collar 39 of the guide 23. The foremost convolution of the spring 61 is preferably centered, e.g., by a short rearwardly extending stub 62 of the collar 39. The spring 61 tends to move the shank 16 rearwardly of and away from the guide 23 and/or to move the guide 23 forwardly and away from the shank so that the coupling pin 56 is normally located in the foremost regions or zones of the elongated front portions 53 of the cam grooves 52 and the bits 24 are retracted into the guide 23. Such starting or neutral positions of the bits 24 are shown in FIGS. 1 and 2. If desired, and as actually shown in FIG. 2, the tips of the bits 24 can extend slightly beyond the cylindrical peripheral surface of the guide 23. All that counts is to ensure that, when held in the retracted positions, the bits 24 can be readily introduced into the drill hole 13 without penetrating into the material surrounding this hole.

In order to form the conical enlargement, the tenon 19 (which has a hole 71) is separably secured to an elongated drilling rod 64 by a piece of wire 63 or a like coupling element which is shown in FIG. 3. The tool 11 is then introduced into the previously drilled hole 13 until the tip 47 of the head plate 44 strikes against the bottom 14. This (but without the drill rod 63) is shown in FIG. 1. The drill rod 63 is then rotated by any suitable means (not shown) in the direction indicated by arrow A shown in FIG. 3 (the rod 63 can be set in rotary motion even before the head plate 44 reaches the innermost portion of the hole 13) whereby the plate 44 bears against the bottom 14 and is at a standstill, i.e., the guide 23 rotates relative to the head 44 and the friction between such parts is negligible owing to the provision of the spherical element 48.

If the drill rod 63 is thereupon moved axially toward the head 44, the shank 16 moves forwardly and into the interior of the guide 23 against the opposition of the spring 61. Such movement of the shank 16 is shared by the bit holders 26 owing to the provision of the pivot member 58 and the foremost portions of the bit holders are caused to move radially outwardly owing to the cooperation between the coupling pin or cam 56 and the surfaces bounding the cam grooves 52. The bits 24 thereby remove material from the adjacent portion of the surface surrounding the hole 13 and form the conical enlargement 12. The elongated front portions 53 of the cam grooves 52 determine the axial length of the conical enlargement 12 as well as the taper of the conical surface bounding such enlargement.

FIG. 3 shows the shank 16 of the tool 11 in the foremost position in which the coupling pin 56 is received in the rearmost zones of rear portions 54 of the cam grooves 52. It will be noted that a relatively small inclination of elongated front portions 53 with reference to the axis of the guide 23 suffices to form a conical enlargement whose maximum diameter appreciably exceeds the diameter of the hole 13. This is desirable and advantageous because the shank 16 can be moved forwardly to deform the spring 61 with the exercise of a relatively small effort. When the coupling pin 56 slides in the rear portions 54 of the cam grooves 52, the taper of the surface bounding the front portion of the enlargement 12 decreases or is terminated because the portions 54 are inclined with reference to the respective portions 53. The angles between the longitudinal extensions of the portions 53, 54 of each cam groove 52 can be readily selected in such a way that the front portion 66 of the conical enlargement 12 is not conical at all, i.e., that it is bounded by a cylindrical surface. The length of the front portion 66 is determined by the length of the rear portions 54 of the cam grooves 52. In the embodiment of FIGS. 1 to 4, the inclination of the portions 54 is selected in such a way that it exceeds the aforementioned angle of 3.5 degrees; therefore, the portion 66 is bounded by a cylindrical surface.

FIG. 4 shows that, as the tool 11 (and more particularly the shank 16 with the guide 23) rotates in the direction indicated by the arrow A, the bit holders 26 rest against the limiting surfaces 31 of the guide 23 irrespective of whether the bits 24 are partly or fully extended. At least the rear portions of the holders 26 abut against the surfaces 31 in all positions of the respective bits 24 (as considered radially of the guide 23).

When the making of the conical enlargement 12 is completed, the shank 16 is retracted or is permitted to move rearwardly under the action of the spring 61. This retracts the bits 24 into the respective windows 28, 29 so that the entire tool 11 can be readily withdrawn from the hole 13. The relatively small inclination of the larger portions 53 of the cam grooves 52 facilitates the retraction of holders 26 into the guide 23. In fact, the spring 61 alone can effect retraction of the holder 26 into the guide 23 so that the pull upon the drill rod 63 is exerted solely or almost exclusively for the purpose of withdrawing the tool from the hole 13. The aforementioned angle between the longitudinal extension of the front portion 53 of each cam groove 52 and the axis of the guide 23 can be reduced to 3 degrees or even less.

The number of bit holders 24 can be increased to three or more without departing from the spirit of the invention. Also, the tool can be used with equal advantage for the making of enlargements or undercuts in materials other than coal or the like.

An important advantage of the improved tool is that the bit holders 26 are installed in the interior of the tubular or substantially tubular guide 23. This renders it possible to retract the holders 26 and their bits 24 into the guide 23 prior to extraction of the tool 11 from the hole 13. The removed material has room around the guide 23 as well as in its interior so that it does not interfere with pivoting of the holders 24 about the axis of the pivot member 58 during retraction of the bits 24 into the respective windows 28, 29 and/or during rearward movement of the holders 26 when the spring 61 expands to return the pivot member 58 into the rearmost portions of the guide slots 34, 35.

The pivot member 58 moves toward the coupling pin or cam 56 during expulsion of the bits 24, i.e., while the bits remove material from the surface surrounding a selected portion of the hole 13. It will be noted that each holder 26 constitutes a one-armed lever whose pivot is at 58 and which is pivoted as a result of engagement between the pin 56 and the surfaces bounding the cam grooves 52. This renders it possible to employ or provide relatively long cam grooves whose inclination with reference to the axis of the guide 23 is small so that the likelihood of jamming during expulsion and/or retraction of the bits 24 is very remote. Moreover, the relatively small inclination of the cam grooves 52 renders it possible to employ a relatively weak spring 61 in order to effect retraction of the bits 24 when the pivot pin 58 is moved from the position of FIG. 3 back to the position of FIG. 1. Still further, and since the cam grooves 52 extend substantially all the way between the front and rear portions of the respective holders 26, such holders can be made shorter than in conventional tools which employ two-armed holders and the cam grooves are machined exclusively into the rear arms of the holders.

As mentioned above, the width of the windows 28 and 29 exceeds the corresponding dimensions of the holders 26 and their bits 24. This can be readily seen in FIGS. 2 and 4. This renders it possible to further reduce the likelihood of jamming or seizing of holders 26 during pivoting of their rear portions on the pin 58 because the removed material has ample room to penetrate through the unoccupied portions of the windows 28 and 29, either into the interior of or into the space around the guide 23.

The provision of a cylindrical portion 66 in front of the conical enlargement or undercut 12, or the provision of a conical portion which replaces the portion 66 and whose taper deviates from that of the conical portion 12, renders it possible to compensate for certain tolerances of anchor bolts or pegs which are to be inserted into the hole 13 upon removal of the tool 11. Moreover, the provision of portion 66 of an analogous portion facilitates the insertion and tightening of the anchor bolts.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A tool for drilling a conical enlargement into the surface surrounding a blind hole having a bottom, particularly into that portion of such surface which is adjacent to the bottom, comprising an enlongated tubular rotary guide insertable into the hole and having a plurality of windows; a plurality of elongated bit holders in said guide, one for each of said windows and each having a front portion provided with a bit and movable radially of said guide so that the bits carried by such front portions can extend outwardly through the respective windows to remove material from the surface around the hole while said guide rotates or be retracted into said guide, said holders further having rear portions and elongated cam grooves intermediate said front and rear portions thereof, cam means provided in said guide and extending transversely of and through said grooves, said holders having surfaces flanking said grooves and being configurated to move the front portions of said holders substantially radially outwardly to extended positions of the bits in response to movement of said holders lengthwise of said guide in a first direction and back into said guide in response to movement of said holders in a second direction counter to said first direction; and means for reciprocating said holders with reference to and axially of said guide, including a shank, means for pivotally connecting said shank with the rear portions of said holders, and means for moving said shank axially of said guide.

2. The tool of claim 1, wherein said guide has limiting surfaces bounding said windows and said bit holders abut against such limiting surfaces, at least while the respective bits remove material from the surface around the hole.

3. The tool of claim 2, wherein said limiting surfaces are contacted by the rear portions of said bit holders in the extended positions of the bits.

4. The tool of claim 1, wherein the width of said windows, as considered in the circumferential direction of said guide, exceeds the corresponding dimensions of those parts of said bit holders which extend into the respective windows.

5. The tool of claim 1, further comprising a head interposed between said guide and the bottom of the hole, said guide being rotatable with reference to said head.

6. The tool of claim 5, further comprising antifriction bearing means interposed between said head and the adjacent part of said guide.

7. The tool of claim 1, wherein said guide has two windows for two holders and said holders are disposed diametrically opposite each other with reference to the axis of said guide.

8. The tool of claim 1, wherein said shank includes a front portion which extends into said guide and said means for moving said shank axially comprises resilient means interposed between said shank and said guide and arranged to urge said shank in a direction to withdraw said front portion thereof from said guide.

9. The tool of claim 8, wherein said guide has a first collar and said shanks has a second collar, said resilient means comprising a helical compression spring reacting against one of said collars and bearing against the other of said collars.

10. The tool of claim 1, wherein said cam means includes a pin extending transversely of said guide and further comprising means for holding said pin against axial movement with references to said guide.

11. The tool of claim 1, wherein said means for pivotally connecting said bit holders to said shank comprises a pivot pin extending transversely of said guide and means for holding said pin against axial movement with reference to said guide.

12. The tool of claim 1, wherein said guide has elongated parallel guide slots for said pin.

13. The tool of claim 1, further comprising means for rotating said guide by eay of said shank.

14. The tool of claim 13, wherein said rotating means comprises a rotary drill rod and means for releasably coupling said rod to said shank.

15. The tool of claim 1, wherein said cam grooves include mutually inclined elongated portions.

16. The tool of claim 15, wherein the longitudinal extension of each of said front portions makes with the axis of said guide an angle of approximately 3 degrees in retracted positions of the bits.

17. The tool of claim 15, wherein said mutually inclined portions of each cam groove include a relatively long front portion and a rear portion, said cam means being being disposed in the front portions of said cam grooves during the making of a conical portion of the enlargement in the surface surrounding the hole into which said guide extends.

18. The tool of claim 15, wherein the rear portion of each of said cam grooves is shorter than the respective front portion.

19. The tool of claim 15, wherein the longitudinal extension of the rear portion of each of said cam grooves makes with the axis of said guide an angle of approximately 5 degrees in retracted positions of the bits.

* * * * *